United States Patent [19]

Jermyn

[11] Patent Number: 4,838,770

[45] Date of Patent: Jun. 13, 1989

[54] PUMPING DEVICE

[76] Inventor: Chester S. Jermyn, 3425 Ardingley Avenue, Burnaby, British Columbia, Canada, V5B 4A7

[21] Appl. No.: 182,416

[22] Filed: Apr. 18, 1988

[51] Int. Cl.[4] ..... F04B 35/00

[52] U.S. Cl. ..... 417/343; 417/551

[58] Field of Search ..... 417/329, 339, 510, 514, 417/515, 374, 343, 551, 547

[56] References Cited

U.S. PATENT DOCUMENTS

| | | | |
|---|---|---|---|
| 172,751 | 1/1876 | Laurence | 417/343 |
| 234,583 | 11/1880 | Kanavel | 417/551 |
| 952,304 | 3/1910 | Buck | 417/551 |
| 2,106,264 | 7/1936 | Anastasakis | 417/329 |

*Primary Examiner*—Carlton R. Croyle
*Assistant Examiner*—Robert N. Blackmon
*Attorney, Agent, or Firm*—Fetherstonhaugh & Co.

[57] ABSTRACT

A pumping mechanism comprising a flat base having a central vertical post and a pair of reciprocal pumping elements mounted on the flat base and situated on either side of the central post. Each of the pumping elements comprises an upper moveable assembly and a lower fixed assembly which slidably accepts the lower portion of the upper movable assembly. A driven member pivotally mounted at the midpoint of its length on the central vertical post has each end pivotably connected to each of the reciprocating pumping elements. The driven member serves to raise and lower the pumping elements in a smooth and steady fashion. A pair of collapsible piston assemblies are located within the upper movable assemblies of the reciprocal pumping elements and are collapsed and formed at the top and bottom of each stroke of the pumping elements.

11 Claims, 3 Drawing Sheets

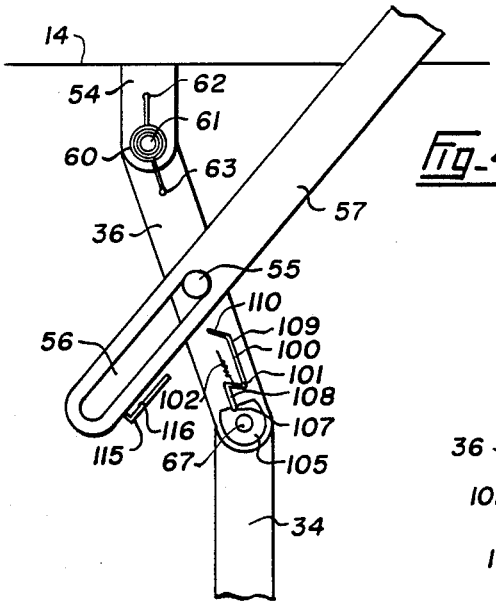
Fig. 4.
Fig. 4a.
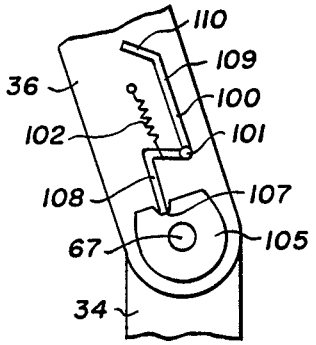
Fig. 5.
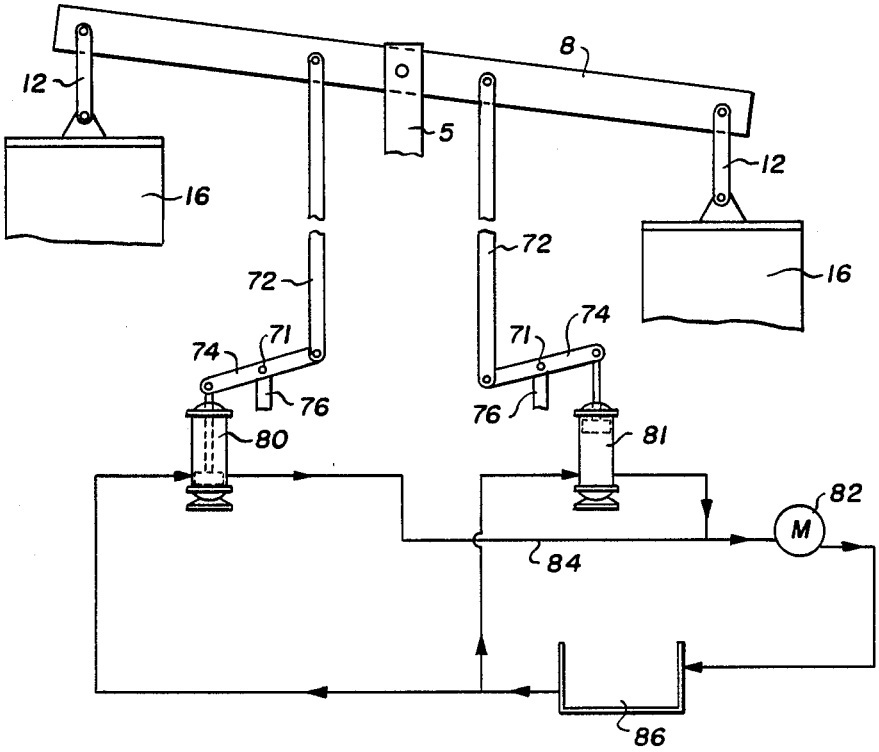

PUMPING DEVICE

FIELD OF THE INVENTION

This invention relates to a pumping mechanism.

This invention is a gravity assisted reciprocating pumping device.

SUMMARY OF THE INVENTION

The present invention is a pumping mechanism comprising:

a flat base having a central vertical post;

a pair of reciprocal pumping elements mounted on said flat base and situated on either side of said central post, each of said pumping elements comprising an upper movable assembly and a lower fixed assembly which slidably accepts the lower portion of said upper movable assembly;

actuating means comprising a driven member pivotally mounted at the midpoint of its length on said central vertical post with each and pivotally connected to each of the reciprocating pumping elements, said driven member serving to raise and lower the pumping elements in a smooth and steady fashion;

a pair of collapsible piston assemblies located within the upper movable assemblies of the reciprocal pumping elements;

means for collapsing and forming said collapsible piston assemblies at the top and bottom of each stroke of the pumping elements.

DESCRIPTION OF THE DRAWINGS

Aspects of the invention are illustrated, merely by way of example, in the accompanying drawings in which:

FIG. 4 is a detailed view of means of collapsing and forming the piston assembly;

FIG. 4*a* is detailed view of the ratchet and pawl used in the means for collapsing and forming the piston assembly;

FIG. 5 is a schematic view of the hydraulic system used to power the pumping device.

DESCRIPTION OF THE PREFERRED EMBODIMENTS

Figure 1:
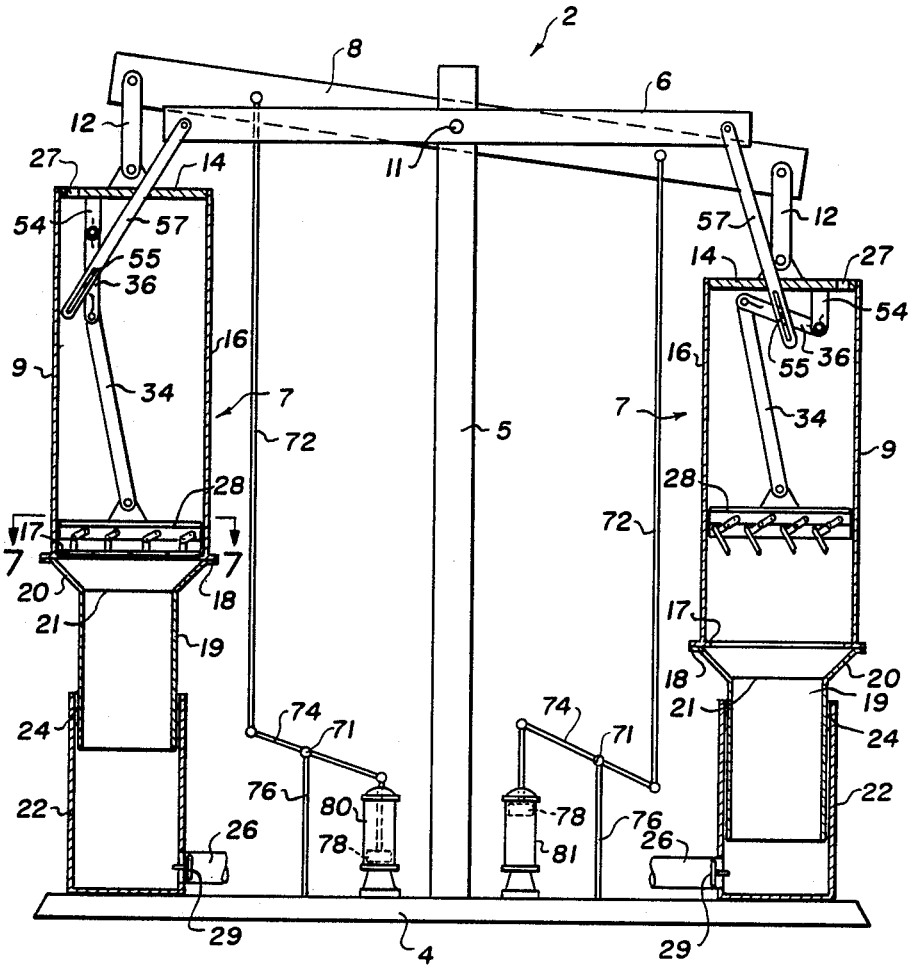
FIG. 1 is a side elevation of a first embodiment the pumping mechanism of the invention with portions broken away to show the interior of the pumping assembly.

Referring to FIG. 1, there is shown a first embodiment of the present invention. Pumping mechanism 2 rests on a flat base 4. A central vertical post 5 is affixed to the center of the base and supports at its upper end a stationary horizontal member 6 and a driving member 8. Stationary horizontal member 6 is firmly attached to vertical post 5 so that it cannot rotate. Driving member 8 is pivotably mounted at its longitudinal midpoint to a sturdy pin 11 received in the top of central vertical post

5. As can be seen from the drawings, there are two pumping elements 7 on either side of the central vertical post 5. As each pumping element and its associated working parts are identical, the whole pumping mechanism being symmetrical about the vertical post, the construction of only one side of the device will be discussed, it being understood that the same applies to the opposite side of the pumping mechanism.

A pumping element 7 consists of two assemblies: An upper movable assembly 9 and a lower fixed assembly 22 firmly attached to base 24. The upper movable assembly 9 is further divided into an upper container 16 with rectangular cross-section which houses a collapsible piston assembly 28 and a lower hollow cylinder 19 attached to the lower end of the upper container 16. Upper container 16 has an upper surface 14 in which is formed an inlet opening 27, which communicates with a fluid source by way of an inlet hose. A short link 12 is pivotably attached to the top 14 of upper container 16, the link's opposite end being pivotably attached to one end of driving member 8.

An internal lip 17 and an external lip 18 are formed around the perimeter of the lower edge of upper container 16. Attached to the external lip 18 is adapter member 20 which forms a transitional aperture 21 between rectangular upper container 16 and circular lower cylinder 19. Hollow cylinder 19 is secured to the lower edge of adapter member 20 and communicates with upper container 16 through large aperture 21.

The hollow cylinder 19 of movable assembly 9 is slidably received in lower fixed assembly 22 which consists of a second hollow cylinder firmly attached to base 4 with a slightly larger diameter than hollow cylinder 19. Cylinder 19 has around its outer circumference a plurality of sealing members 24 that maintain a fluid tight seal between cylinder 19 and cylinder 22. A fluid discharge pipe 26 transports fluid from the base of cylinder 22 through a conventional one way valve 29 to a desired location.

Figure 2:
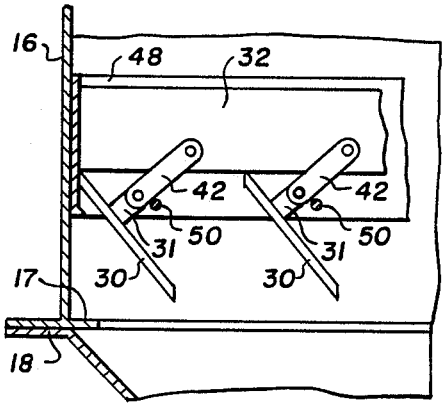
FIG. 2 is a detailed view of the collapsible piston assembly in the open position.
Figure 3:
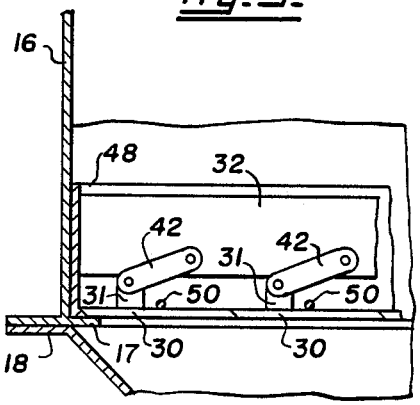
FIG. 3 is a detailed view of the collapsible piston in the closed position.

A collapsible piston assembly 28 is housed within upper container 16 and comprises a plurality of thin, flat closure plates 30 with upper surface tabs 31 as best shown in FIGS. 2 and 3. Tabs 31 are pivotably attached to link arms 42 and link arms 42 are in turn pivotably secured to central mounting plate 32 of guide frame 48. All closure plates have identical parallelogram cross-sections and the plates are arranged such that adjacent edges overlap - see FIGS. 2 and 7.

Figure 7:
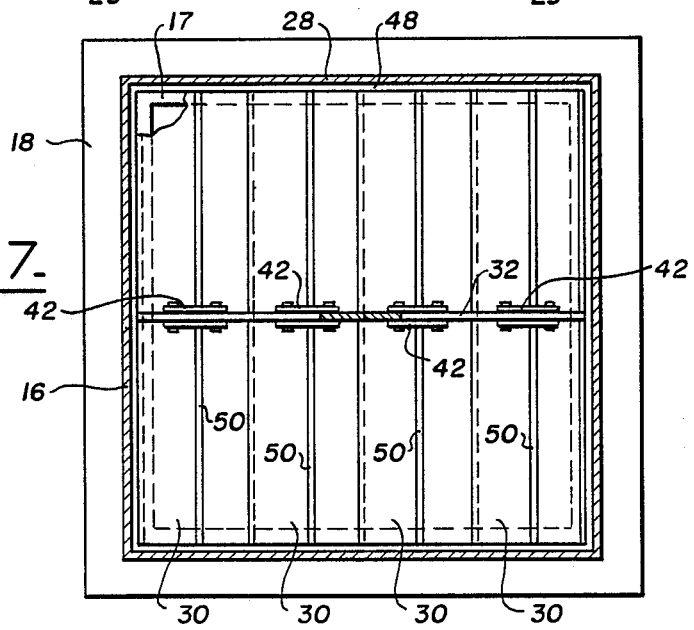
FIG. 7 is a section view taken along line 7—7 of FIG. 1 showing a plan view of the collapsible piston assembly.

As shown in FIGS. 2 and 7, guide frame 48 fits slidably within upper container 16. A plurality of small diameter rods 50 are mounted between the walls of guide frame 48 perpendicular to central mounting plate 32 and above closure plate 30. Rods 50 serve to restrict the pivotal movement of plates 30 as will be discussed below.

The operation of the pumping device of the present invention relies on piston assembly 28 being formed and collapsed by appropriate means. In the embodiment of FIG. 1, the piston collapsing and forming means comprises the linkage system interconnecting piston assembly 28 and stationary horizontal member 6. This linkage system includes upwardly extending link 34 which is pivotably attached to central mounting plate 32 of piston assembly 28. Link 34, in turn, is pivotably attached to a second shorter link 36. Link 36 is pivotably secured to the top 14 of upper container 16 by tab 54. Projection 55 extends perpendicularly from link 36 and is slidably engaged in slot 56 of link member 57. Link member 57 extends through the top 14 of upper container 16 and is pivotably connected to one end of stationary member 6.

FIGS. 4 and 4a are more detailed views of the linkage system found inside upper container 16. Heavy duty helical spring 60 is wound around pin 61 which forms the pivoting joint between tab 54 and link 36. Ends 62 and 63 of spring 60 are attached respectively to tab 54 and link 36 and spring 60 is installed about pin 61 in a known manner so as to cause link 36 to rotate upwardly in a counterclockwise direction about the axis of pin 61 as shown in FIG. 4 when the collapsible piston assembly is not in a closed position as will be more fully described below.

A locking system comprising pawl 100 and ratchet 105 is located towards the lower end of link 36. Ratchet 105 with single recess 107 is mounted on pin 67 which forms the pivoting joint between link 36 and link 34. Pawl 100 is pivotably mounted to arm 36 by pin 101. Biasing spring 102 serves to force locking arm 108 against the outer circumference of ratchet 105. Pawl arm 109 ends in angled flange 110 which can engage tab 115 attached to the lower end of slotted link 57, the surface 116 of the tab beginning on a line tangential to the lower end of slot 56 and perpendicular to the longitudinal axis of slotted link 57.

In the embodiment of FIG. 1 the entire pumping mechanism is operated using a conventional hydraulic system as shown in FIG. 5. Two sets of driving links are pivotably attached on the longitudinal axis of driving member 8 to opposite sides of central post 5. Each system of links comprises a long, vertically disposed link 72 pivotably connected at its upper end to driving member 8 and pivotably connected at its lower end to one end of a shorter, horizontally disposed link 74. Link 74 is pivotably mounted at point 71 along its length to support 76 and pivotably secured to piston 78 of a conventional hydraulic cylinder 80 at its end opposite that attached to link 72. As is shown schematically in FIG. 4, the hydraulic motor 82 communicates with cylinder 80 via hydraulic lines 84. An oil reservoir 86 is provided.

The pumping mechanism of the first embodiment operates as follows:

Motor 82 circulates hydraulic fluid through lines 84, into reservoir 86 and through a further set of hydraulic lines that are connected to cylinders 80 and 81. As shown in FIGS. 1 and 4, the inflow of fluid into the right hand cylinder 81 causes the piston 78 to be forced upwardly. This causes link 74 to pivot about support 76 and pull link 72 downwardly. Since link 72 is attached to drive bar 8, the bar 8 is pivoted about pin 11 and pulled downwardly on the right side. The opposite end of the drive bar 8, the end on the left of FIG. 1, is correspondingly raised. When piston 78 reaches the upper limit of its travel, hydraulic fluid is switched to the opposite hydraulic cylinder 80, and through an identical process as described above, the upward movement of the piston in hydraulic cylinder 80 causes the left hand side of drive bar 8, as shown in FIG. 1, to be lowered. Thus, this movement of hydraulic fluid between cylinders 80 and 81 by the action of hydraulic motor 82 causes the drive bar 8 to be pivoted about the pivot pin 111.

The pivoting motion of drive bar 8 about pivot point 11 serves to drive the upper movable assemblies 9 of pumping elements 7 up and down as short link 12 transmits the reciprocating motion of the driving member 8 to each pumping element.

In turn, the reciprocating motion of the upper movable assembly 9 serves to power the operation of the rest of the pumping mechanism. Fluid, flowing under gravity, continually enters both pumping elements 7 through openings 27 in the tops 14 of upper containers 16. As an upper movable assembly 9 moves upwardly during a stroke, the upper end of slot 56 formed in slotted link 57 applies a force to tab 55 extending perpendicularly from link 36. This applied force causes link 36 to rotate downwardly about pin 61 connecting tab 54 and link 36. Accordingly, the downward motion of link 36 causes piston assembly 28 to move downwardly in upper container 16. The downward motion of link 36 also tensions helical spring 60. When an upper movable assembly 9 reaches the top of its stroke, slotted link 57, acting on tab 55, has rotated link 36 sufficiently to allow locking arm 108 of pawl 100 to engage recess 107 in ratchet 105; thereby locking arm 34 in position to hold collapsible assembly 28 closed against flange 17 of upper container 16, as shown in FIG. 4. Collapsible piston assembly 28 now appears as in FIG. 3. Closure plates 30 are sealed against internal flange 17 of upper container 16 and this sealing of the closure plates 30 separates the pumping elements 7 into two volumes, an upper volume consisting of upper container 16 and a lower sealed volume comprising hollow cylinder 19 slidably received and sealed with rings 24 inside cylinder 22.

Upper movably assembly 9 now begins moving downwardly in its normal pumping cycle. As upper container 16 is forced downwardly by driving arm 8 the lower sealed volume decreases as hollow cylinder 19 slides into cylinder 22. As a result, water in the lower sealed volume is displaced, through the one-way valve 29 in fixed cylinder 22, into discharge pipe 26 and to the desired location. As upper movable assembly 9 moves downwardly, tab 55 slides freely downwardly in slot 56 of slotted link 57, and piston assembly 28 remains in its closed sealed position. In addition, fluid continues to flow into upper container 16 which is now sealed at its lower edge by closure plates 30. This increasing mass of fluid provides additional weight which assists driving member 8 in moving upper movable assembly 9 downwardly. The additional weight of incoming fluid also assists in holding closure plates downwardly against internal flange 17 against the fluid pressure developed in the lower sealed volume. Closure plates 30 are also held in place and prevented from pivoting about arm 42 by rods 50 mounted between the walls of guide frame 48, as shown in FIG. 2.

When upper movable assembly 9 reaches the bottom of its stroke, the lower end of slot 56 applies an upward force to tab 55 and, at the same time, releasing tab 115 of slotted link 57 engages angled flange 110 of pawl 100 pivoting the pawl 100 about point 101 and releasing locking arm 108 from recess 107. With arm 34 no longer locked in position, the force applied by the lower end of slot 56 on tab 55 begins to rotate link 36 upwardly, raising piston assembly 28. The upward movement of piston assembly 28 causes closure plates 30 to open slightly due to the mass of fluid above acting on the plate when the plates are no longer supported below by internal lip 17. With closure plates 30 now slightly opened to allow fluid to pass through into hollow cylinder 19 and fixed cylinder 22, tensioned helical spring 60 provides the necessary force to cause link 36 to swing upwardly, sliding piston assembly 28 upwardly in upper container 16 into its fully open position shown in FIG.

2. Tab 55 slides along slot 56 until the upper end of the slot is reached. Slotted link 57 pivots about its attachment point to stationary bar 6 to allow tab 55 to slide smoothly along slot 56. Upper movable assembly 9 continues its upward travel with open piston assembly 28 offering much reduced resistance to fluid flow. As upper movable assembly 9 travels upwardly, the upper end of slot 56 applies a force to tab 55 which slowly closes piston assembly 28 in the manner previously described. When the upper movable assembly 9 reaches the top of its stroke, link 34 is locked into position, sealing piston assembly 28 against internal lip 17. The cycle as previously described is then repeated.

It will be appreciated from FIG. 1 that when one pumping element 7 is moving downwardly and pumping fluid the other is moving upwardly. Thus, a continuous flow of fluid is pumped through outlet pipe 26 by alternating pump strokes of the two pumping elements.

Figure 6:
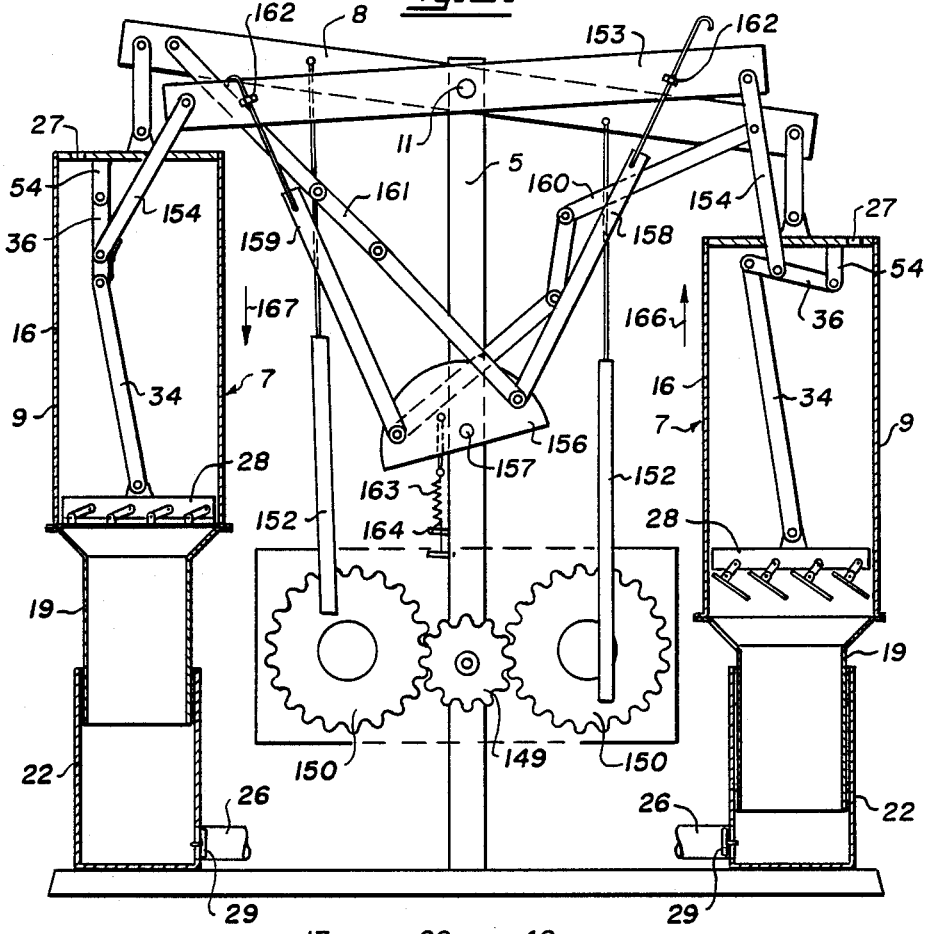
FIG. 6 is a side elevation of a second embodiment of the pumping device.

FIG. 6 shows a second embodiment of the present invention which uses a different means for forming and collapsing the piston assembly 28. As well, the embodiment of FIG. 6 uses a different drive system comprising rotating cogs 150 and link arms 152 driven by central drive shaft 149 in order to reciprocate driving member 8. This drive system is an alternative to the previously described hydraulic system and as such the two drive systems are interchangeable.

In FIG. 6, parts of the pumping device corresponding to those of the first embodiment are similarly numbered. The actual pumping action of the pump device is as previously described with a gravity fed supply of water entering through opening 27 and being pumped through one way outlet valve 29 and discharge pipe 26. Collapsing and forming the piston assemblies 28 is done differently, however. The stationary horizontal member 6 of FIG. 1 is replaced by pivoting bar 153 joined to central vertical post 5 at joint 11. Pivoting bar 153 is connected at each end through links 154 with connecting links 36 within the upper container 16 of a pumping element 7. The movement of pivoting bar 153 is coordinated and controlled by pivoting assembly 156 mounted to post 5 at pivot 157. Pivoting assembly 56 is mounted to post 5 such that the end portions of the assembly extend to either side of an imaginary vertical plane through post 5. Attached to and extending outwardly from opposite end portions of pivoting assembly 156 are hook members 158 and 159 and collapsible link members 160 and 161. Hook members 158 and 159 extend upwardly and outwardly and are slidably support in eyes 162 on pivoting bar 153. The upper end of hook members 158 and 159 are formed into hooks adapted to engage the upper surface of pivoting bar 153 as required. Collapsible link members 160 and 161 are formed from pivotally connected links and extend from opposite and portions of pivoting assembly 156 to opposite sides of driving bar 8 such that the link members cross each other and intersect the vertical plane through post 5 as shown in FIG. 6. Spring 163 is attached to one end portion of pivoting assembly 156. Spring 163 extends downwardly to mount 164 on post 5 and serves to tilt the pivoting assembly to one side of post 5.

As in the embodiment of FIG. 1, the present pumping device is moved by the external power source which in this case is the rotating cog drive. Link arms 152 reciprocate drive bar 8 to drive the upper movable piston assemblies 9. In FIG. 6, the upper movable piston assembly on the left is just beginning a downward pumping stroke as indicated by arrow 167 and the upper movable piston assembly on the right is just beginning an upward stroke as indicated by arrow 166. Pivoting assembly 156 is tilted to the left due to the action of spring 163 and straightened collapsible link member 161. This tilting of the pivoting assembly 156 causes hook member 159 to descend relative to pivoting bar 153 thereby engaging the upper surface of the bar and pivoting the bar to the left which causes the left hand side piston assembly 28 to be formed and sealed ready for the downstroke. At the same time, hook arm 158 and the right end of bar 153 move upwardly causing the right hand side piston assembly 28 to collapse to ease the upstroke motion.

Collapsible link members 160 and 161 provide the means to tilt pivoting assembly 156 so that hook members 158 and 159 engage pivoting bar 153 at appropriate times to form and collapse piston assemblies 28. Collapsing and forming the piston assemblies only needs to occur at the top and bottom of each stroke. As the right hand upper movable piston assembly moves upwardly collapsible link member 160 will tend to straighten while collapsible link member 161 will tend to collapse. Therefore, when the right hand pumping element reaches its uppermost position and the left hand pumping element reaches its lowermost position, collapsible link member 160 will be straight while link member 161 will be collapsed causing pivoting assembly 156 to pivot to the right thereby forming the right hand piston assembly and collapsing the left hand piston assembly in preparation for continued motion of the pumping device. Such a collapsing and forming action occurs for each cycle of the pump.

I claim:

1. A pumping mechanism comprising:

a flat base having a central vertical post;

a pair of reciprocal pumping elements mounted on said flat base and situated on either side of said central post, each of said pumping elements comprising an upper movable assembly having an upper container and a lower portion, and a lower fixed assembly;

actuating means comprising a driven member pivotally mounted at the midpoint of its length on said central vertical post with each end pivotably connected to each of the reciprocating pumping elements, said driven member serving to raise and lower the pumping elements in a smooth and steady fashion;

a pair of collapsible piston assemblies located within the upper movable assemblies of the reciprocal pumping elements;

means for collapsing and forming said collapsible piston assemblies at the top and bottom of each stroke of the pumping elements;

said upper container of said upper movable assembly being pivotably connected to said actuating means and having internal and external lips about the perimeter of the upper container's lower edge;

and said lower portion of said upper movable assembly comprising a hollow cylinder communicating with said upper container and secured to the base of said upper container by fastening means on said external lip, said lower portion being slidably received in said lower fixed assembly with means to maintain a fluid tight seal.

2. A mechanism as claimed in claim 1 in which the lower fixed assembly comprises a hollow cylinder firmly attached to said base and adapted to slidably receive said lower portion of said upper movable assembly, having a one way valve communicating with an outflow pipe.

3. A mechanism as claimed in claim 1 in which the collapsible piston assembly comprises a plurality of thin, flat closure plates pivotably attached by links to a central mounting plate of a guide frame which fits slidably within said upper container of said upper movable assembly of said pumping element, said mounting plate being pivotably connected to means for collapsing and forming said collapsible piston assembly.

4. A mechanism as claimed in claim 3 in which the thin flat closure plates are limited in their rotational movement by spanning guide members mounted between the guide frame walls.

5. A mechanism as claimed in claim 4 in which the thin, flat closure plates rest against the internal lip of the upper container of the upper movable assembly of the pumping element when the closure plates are in a closed position.

6. A mechanism as claimed in claim 1 in which the means for collapsing and forming the collapsing piston assembly comprises:

linking means comprising a lower vertically disposed link pivotably connected at one end to said guide frame of said collapsible piston assembly and pivotably connected at the link's other end to one end of a connecting link, the connecting link being itself pivotably connected at the other end to a tab rigidly connected to the upper surface of the movable assembly of the pumping element:

locking means attached to the connecting link of said linking means;

spring means; and actuating means comprising a horizontally disposed stationary member rigidly attached to said central vertical post at its longitudinal midpoint and pivotably connected at each end to slotted members with releasing means, said slotted members slidably engaging a projection on said connecting link of said linking means.

7. A mechanism as claimed in claim 6 in which the locking means comprises a pawl and ratchet assembly.

8. A mechanism as claimed in claim 6 in which the releasing means attached to the slotted member comprises an outwardly projecting tab located towards the free end of said slotted member to engage and release said ratchet member of said locking means.

9. A mechanism as claimed in claim 6 in which the spring means comprises a heavy duty helical spring wound about the pivotable joint connecting said tab to said connecting link with one end of said spring attached to said tab and the other end connected to said connecting link.

10. A mechanism as claimed in claim 1 in which said means for collapsing and forming the collapsible piston assembly comprises:

linking means comprising a lower vertically disposed link pivotably connected at one end to said guide frame of said collapsible piston assembly and pivotably connected at the link's other end to one end of a connecting link, the connecting link being itself pivotably connected at the other end to a tab rigidly connected to the upper surface of the movable assembly of the pumping element;

a spring biased pivoting assembly pivotally mounted to said central vertical post with attached hook members for engaging and positioning a pivoting bar attached to said central post, said pivoting bar acting on said connecting links of said linking means to collapse and form said piston assembly.

11. A mechanism as claimed in claim 10 in which the movement of said spring biased pivoting assembly is coordinated by criss-crossing collapsible links that extend from opposite sides of said pivoting assembly across the vertical plane of said central vertical to opposite ends of said driven member.

* * * * *